US005423913A

United States Patent [19]

Fontaine

[11] Patent Number: 5,423,913

[45] Date of Patent: Jun. 13, 1995

[54] APPARATUS AND METHOD FOR CONTROL OF METALLIC COATING-WEIGHT BY THE USE OF GAS KNIVES

[76] Inventor: Paul P. Fontaine, P.O. Box 3154, D.4018 Langenfeld, Germany

[21] Appl. No.: 785,081

[22] Filed: Oct. 30, 1991

[51] Int. Cl.[6] ..... B05C 11/06

[52] U.S. Cl. ..... 118/63; 15/422.1; 15/316.1

[58] Field of Search ..... 118/63, 689; 15/422.1, 15/316.1, 405; 239/455, 597

[56] References Cited

U.S. PATENT DOCUMENTS

| | | | |
|---|---|---|---|
| 2,415,644 | 2/1947 | Leonhard et al. . | |
| 2,545,266 | 3/1951 | Dickhaut et al. . | |
| 3,753,418 | 8/1973 | Roncan . | |
| 3,841,557 | 10/1974 | Atkinson . | |
| 3,917,888 | 11/1975 | Beam et al. . | |
| 3,938,468 | 2/1976 | Kirscher . | |
| 3,941,086 | 3/1976 | Roncan . | |
| 3,988,517 | 10/1976 | Leonard . | |
| 4,106,429 | 8/1978 | Phillips . | |
| 4,384,678 | 5/1983 | Bouette | 239/455 |
| 4,513,915 | 4/1985 | Kohler . | |
| 4,524,716 | 6/1985 | Mueller . | |
| 4,535,936 | 8/1985 | Fontaine . | |
| 5,127,581 | 7/1992 | Kuwano | 239/455 |

FOREIGN PATENT DOCUMENTS

| | | | |
|---|---|---|---|
| 649256 | 5/1948 | United Kingdom | 239/455 |

*Primary Examiner*—W. Gary Jones
*Assistant Examiner*—Brenda Lamb
*Attorney, Agent, or Firm*—Charles A. Wilkinson

[57] ABSTRACT

A gas wiping die is provided with a predetermined arrangement of cams which act against a flexible lip either directly or through intermediate push rods or the like to adjust the opening of the wiping die orifice. The invention may involve several cam shafts which may be rotated by a so-called stepping motor or motors. The arrangement allows a smooth progression of changes in the opening and camber of the coating die gas orifice slot. Various contours of cam shaft may be provided to provide easily implemented programs of die adjustment, either smoothly or discretely, to adjust for variations in coating conditions or procedure.

23 Claims, 6 Drawing Sheets

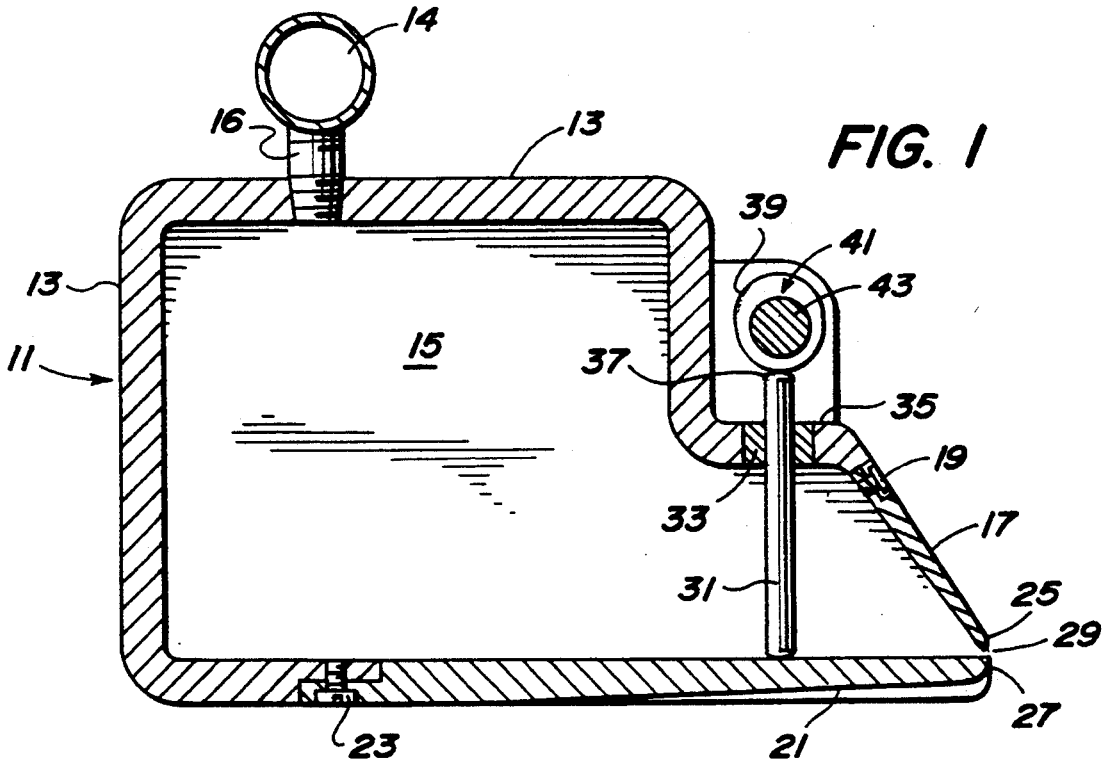
FIG. 1
FIG. 2
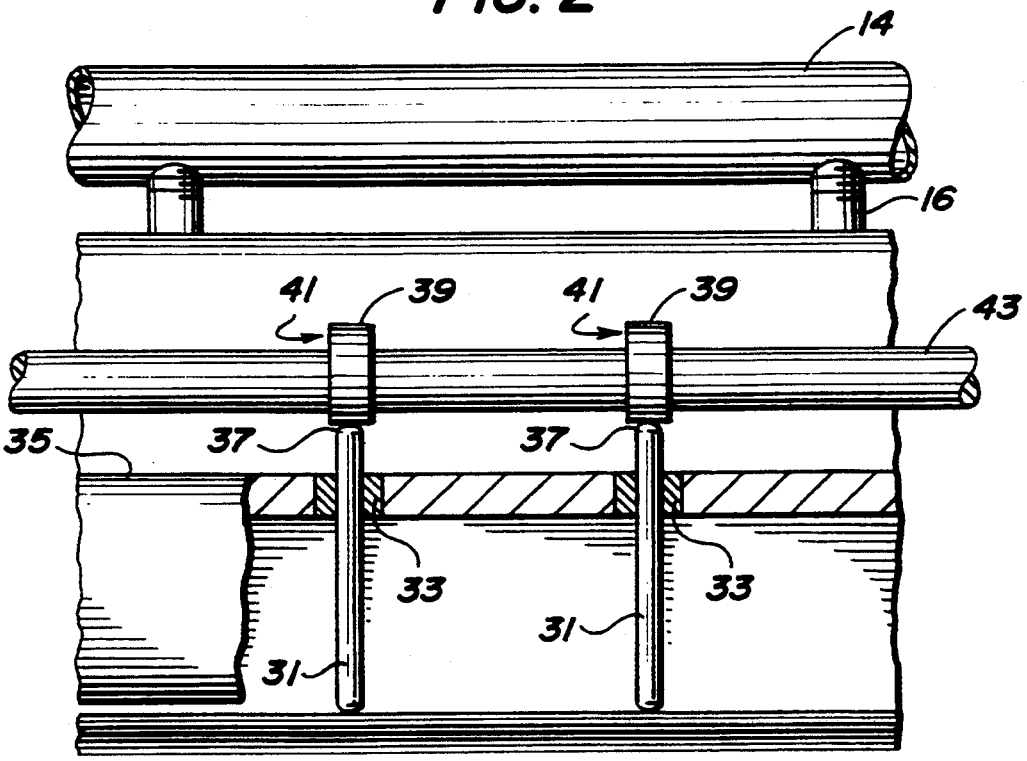

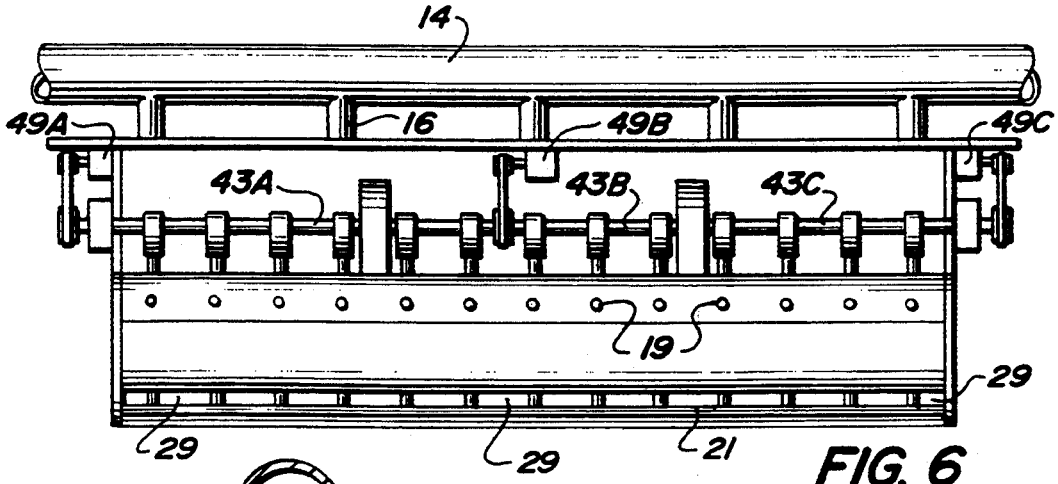
FIG. 6
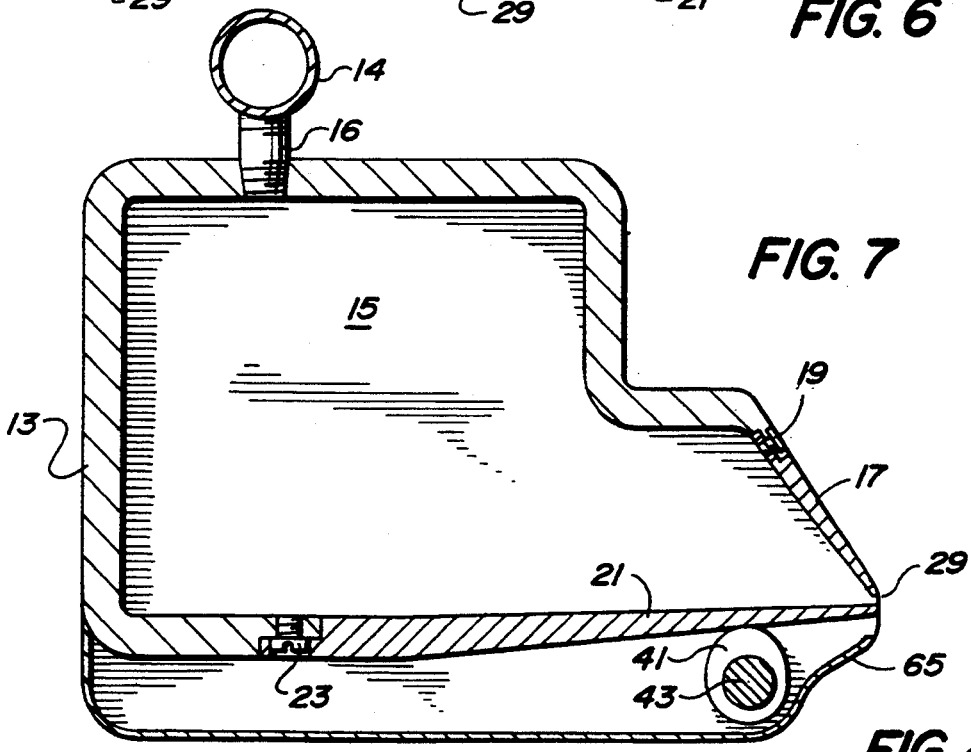
FIG. 7
FIG. 8
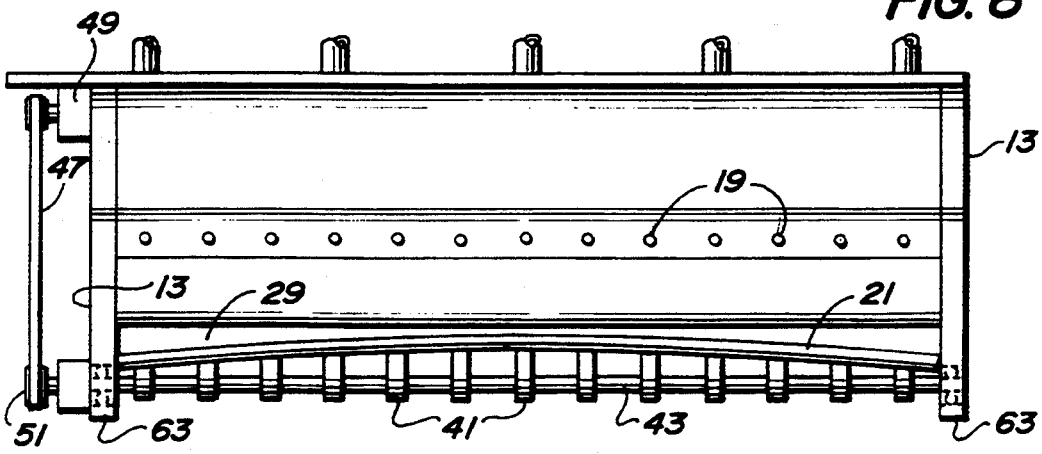

APPARATUS AND METHOD FOR CONTROL OF METALLIC COATING-WEIGHT BY THE USE OF GAS KNIVES

BACKGROUND OF THE INVENTION (1) Field of the Invention

This invention relates to the coating of metal strips with uniform coating weights and more particularly to the determination or control of the coating weight on hot-metal coated strips with so-called gas doctors or gas knives, and particularly to the use of adjustable orifice gas knives.

(2) Description of the Prior Art

Various means have been used to control the coating weight of so-called hot dip coated strip and sheet material and particularly ferrous-base sheet and strip material which is passed through molten baths of tern, zinc, aluminum, aluminum-zinc and the like. In the coating of such material, the ferrous substrate material as it exits from the bath surface, draws up with it a quantity of at least temporarily adhering molten metal, which, as the ferrous material passes upwardly, solidifies on the surface of the base material. If the strip or sheet material is withdrawn from the bath sufficiently slowly, the excess molten metal will drain from the surface naturally establishing a coating thickness or weight dependent basically upon the temperature of the substrate as well as the coating plus the physical characteristics of the unsolidified coating material, particularly the weight or specific gravity. As coating lines have been accelerated, however, too much excess coating has been drawn up from the molten bath upon the surface of the substrate and has not had sufficient time to drain back into the molten bath causing overly thick as well as uneven coatings on the coated product.

Various expedients have been used to wipe this excess coating from the substrate;surface including charcoal or the like floating upon the bath surface, stationary wipers between which the strip passes, so-called coating rolls between which the strip passes and in more modern practice blasts of gas which wipe the molten coating back into the bath leaving the desired residual surface layer which then solidifies, forming the ultimate coating upon the substrate.

The use of coating or doctor rolls between which the ferrous substrate passed as it exited from the molten bath was a very significant improvement in hot metal coating of sheet and strip material and over a period, the use of such rolls became very sophisticated in design and implementation. These coating rolls essentially limited the amount of metal drawn out of the metal bath with the substrate and then allowed the metal to be recoated with hot metal from the limited reservoir of metal between the rolls. The coating weight could be controlled by the pressure applied between the rolls and the depth the rolls were submerged in the molten bath. Almost all such sophisticated coating roll systems have now, however, been superseded by even more sophisticated gas or fluid wiping apparatus which is more flexible and longer lasting and, in general, does a better job at a lesser cost.

In the fluid or gas Wiping process as used in the steel industry, a gas such as steam, air, nitrogen or other gaseous fluid is forced from a plenum chamber through a narrow slot or slit and directed against a molten metal coated steel strip or sheet as it passes upwardly from the molten coating bath past or by the slot. The narrow elongated blast of gas issuing from the slot wipes excess molten coating from the surface of the metal base and generally smooths the molten surface. Such gas wiping devices are generally referred to as fluid knives or wipers, or, if air is the wiping fluid, usually as air knives or wipers. They are also sometimes referred to as air doctors.

Fluid-wiping techniques have, in turn, developed into very sophisticated systems and a number of apparatus designs have been developed to wipe or smooth various molten coatings including zinc and aluminum and combinations of zinc and aluminum. One persistent problem has been that of so-called edge buildup in which the coating is thicker along the edges of the coated material due generally to less effective wiping at the edges as the result of interference between oppositely directed blasts of gas wiping the two opposite sides of the strip or sheet material. This has necessitated the use of increased slot diameters at the ends of the gas wiping orifices or slots near the sides of the strip or sheet material. However, since the ultimate coating weight is a function of a number of factors, including, primarily, strip or line speed, strip width and surface finish, strip temperature as well as the molten bath temperature, distance of the gas nozzle from the strip, gas flow through the nozzle and configuration of the nozzle, it is difficult to provide and, in fact, so far as it is known, impossible to provide a single nozzle or slot width and configuration that will be suitable for all coating conditions. Superimposed upon these enumerated factors in any particular coating bath is the further complication that each coating material has its own characteristics which inherently change the characteristics of the wiping operation. For example, molten zinc is inherently heavier than molten aluminum so that the effects of gravity tend to be more pronounced and a lesser blast of wiping gas will, in most cases, be effective to remove more molten zinc coating material than aluminum coating material. The amount of edge buildup, furthermore, is likely to be significantly less. Thus, in changing from one to another coating material, a new coating nozzle or wiping air die is usually necessary, requiring not only the changing of nozzles or wiping dies, a not inconsiderable job, but the maintenance of an inventory of different nozzles and dies which inventory is by no means, inexpensive.

Changes in line speed during operation of a coating bath, cooling of the strip, particularly if it has been heated in batch-type rather than in-line furnaces, changes in bath temperature and the like may also have considerable influence upon the wiping of the molten coated surface with a fluid wiper. For example, the molten bath and the strip or sheet being coated are seldom, if ever, of similar temperatures when they are brought together by the strip being immersed in the bath. Consequently, if the strip is cooler, the bath will tend to be cooled and, if the strip is hotter, the bath will tend to be heated as the strip is passed through the bath and the bath will tend to recover in the intervals between strips. This factor in itself causes the coating on the strip to vary progressively in a pattern from end to end. While small, such variation may assume importance for certain products and can be of relatively great economic significance in large scale operations, where any excess coating can assume considerable importance in cost of coating.

It has been recognized, therefore, that it would be desirable to have an infinitely adjustable slot width within normal operating limits which could, in particular, be adjusted while a coating line is operating to make adjustments for other variable factors of the coating operation as well as to make deliberate changes when such appear desirable. For example, it may at times be convenient to change the coating weight part way through the coating of a coil to accommodate a particular order and the like.

It would, in particular, be convenient if the width and configuration of the slot of a gas wiping die could be altered or varied easily, not only between orders or dependent upon coating conditions, but also as a coating operation progresses. Among prior attempts to provide variable orifices to conveniently make changes in the coating of a substrate may be mentioned the following:

U.S. Pat. No. 2,415,644 issued Feb. 11, 1947 to L. W. Leonhard et al. discloses an early form of doctor blade or air knife for smoothing and wiping the coating on a strip or web. Changes in the coating weight obtained by changing various parameters of the coating process, including the gas pressure, the width of the gas wiping orifice and other expedients are mentioned or discussed. Leonhard et al. discloses an air knife having two halves held together by adjusting and locking bolts. These bolts extending through the center of the enclosed chamber may in one embodiment be adjusted by a mechanical arrangement to adjust the opening of the gas orifice between the two halves of the die body in accordance with a control system. While the Leonhard et al. apparatus is designed especially for coating nonmetallic webs and the like and is arranged to operate on only one side of the web, it would probably be applicable also to the coating of metal strip and sheet material.

U.S. Pat. No. 3,753,418 issued Aug. 21, 1973 to R. Roncan discloses a wiping die arrangement for ferrous sheet and strip incorporating a nonadjustable upper lip opposed to an adjustable or flexible lip. The flexible lower lip may be adjusted by means of a mechanical screw arrangement which, through a series of rotating arms and intermediate inter-meshing gears, forces the flexible lip up and down to adjust the distance between the lips. Differential adjustment along the length of the lip is said to be attainable.

U.S. Pat. No. 3,841,557 issued Oct. 15, 1974 to E. S. Atkinson discloses a gas wiping die in which the width of the slot from which the gas issues can be selectively adjusted by means of heating elements positioned at closely spaced intervals in one-half of the die. Atkinson, in his background discussion, discloses prior use of removable shims or inserts and the use of adjusting screws or bolts to warp the walls of the gas slot with respect to each other. These prior methods were slow and required an excessive amount of labor, however.

U.S. Pat. No. 3,917,888 issued Nov. 4, 1975 to D. J. Beam et al. discloses a gas wiping die in which the orifice width can be selectively changed by sliding into place on one lip, a variable insert member. The rate of taper of the opening can be adjusted by inserting different adjustment strips on the lip.

U.S. Pat. No. 3,938,468 issued Feb. 17, 1976 to J. B. Kirschner discloses a gas wiping die having a variable slot valve means mounted in or between the lips of the gas orifice of the die to change the effective cross section of the orifice. The valve means is in the form of a long, substantially round member or bar mounted in a circular opening within the die lips. The circular member is relieved in a certain pattern along one side to form a variable valve surface to allow the escape of gas past the rotatable valve member.

U.S. Pat. No. 4,106,429 issued Aug. 15, 1978 to I. J. Phillips discloses a gas wiping die in which the wiping orifice may be varied in size by moving the lips of the wiping orifice of the die longitudinally toward or away from the material being wiped. The lips are moved longitudinally with respect to the remainder of the wiping die. Such longitudinal movement is effected by a rotatable cam arrangement journaled within the lip structure itself. When a cam is rotated, it causes the separate lip structure to slide laterally with respect to the remaining structure of the wiping die, in effect, lengthening or shortening the lips.

U.S. Pat. No. 4,524,716 issued Jun. 25, 1985 to H. J. Mueller discloses a recent gas wiping die particularly for use in the paper coating arts. The Mueller die has converging lips and is provided with a flexible gas flow modification member in the form of a semi-stopper directly behind the opening of the lips. This stopper may be moved toward and away from the opening in the lips to relatively open or close the orifice and thereby control the flow of gas from the lips.

As can be seen from the above citations of prior patented gas wiping dies, there have been a fair number of attempts to produce a practical wiping die having a variable, and preferably, an infinitely variable die orifice. However, each has had certain disadvantages and no really satisfactory arrangement for varying the contour of the lips of the gas die to vary the flow of gas through various portions of the gas die to allow for varying conditions on a coating line have been either designed or developed. There is, consequently, a need for a practical gas wiping die or gas doctor, particularly for wiping and smoothing molten metal on the surface of ferrous strip and sheet material that may be conveniently varied in cross section to quickly vary the amount of gas issuing from the die at any given location across the face of the die to allow for variations in the operation of the coating line.

BRIEF DESCRIPTION OF THE INVENTION

The present invention provides a gas wiping die for the wiping of molten coatings on flat material passing from a molten coating bath and particularly a molten metal coating bath, The wiping die is provided with at least one flexible or movable lip which is preferably permanently biased in one direction and urged in the opposite direction to tend to open or close the gas wiping die orifice by a multiple cam arrangement, The multiple cams are mounted upon or form an integral part of a cam shaft which is in mechanical contact either directly or indirectly with the flexible lip, Rotation of the cam shaft causes the multiple cams or the various sections of a differential cam or cams to exert more or less force against the movable or flexible lips to adjust them to open or close the die orifice at the effective location of the particular cam diameter in order to control the passage of wiping gas through this portion of the wiping die orifice. More than one cam shaft may be used to exert variable force against the flexible lip. Preferably an electrical stepping motor or motors is or are used to operate the cam shaft or shafts which control the opening between the lips of the die orifice at various positions along the orifice, The cam shafts may be used in conjunction with and/or replaced by differently contoured cam shaft assemblies to vary the adjustments possible. The cam shaft assemblies or equivalent functioning arrangements may be used to progressively vary the opening of wiping dies in a predetermined manner as a strip passes through a coating line to adjust for regularly recurring changes in coating distribution from one end of a coated strip to the other.

OBJECTS OF THE INVENTION

It is an object of the present invention, therefore, to provide a gas wiping die in which the width of the wiping orifice may be varied from portion-to-portion or location-to-location across the face of the die to adjust for changes in the operating parameters of a coating line.

It is a further object of the invention to provide a gas wiping die in which the opening of the gas wiping orifice may be easily varied in a predetermined ratio across the face of the die with changes in the coating operations.

It is a still further object of the invention to provide a substantially infinitely adjustable orifice across the face of a gas wiping die to facilitate control of the wiping gas force upon various portions of a coated strip or sheet passing the coating die.

It is a still further object of the invention to provide an arrangement for differentially varying the width of the opening in a gas wiping die by means of a predetermined cam-shaft arrangement acting directly upon the lips of a wiping die.

It is a still further object of the invention to provide an arrangement for varying the opening of the orifice of a gas wiping die across the face of the die by means of a predetermined shape of a rotatable cam shaft controlling the position of the lips.

It is a still further object of this invention to provide an arrangement for varying the opening of a wiping die by means of an easily changeable cam shaft.

It is a still further object of the invention to provide a method of varying the wiping of a strip or sheet material with a gas wiping die during the coating of a single length of coil in a predetermined manner to allow for a progressive change in line or coating conditions during the coating of a single coil.

It is a still further object of the invention to provide a coating die apparatus that is effective to accurately and conveniently vary, in a predetermined manner, the opening of the wiping orifice of a gas wiping die by a single, foolproof mechanical arrangement.

It is a still further object of the invention to provide a convenient and effective arrangement for varying the opening across the face of a gas wiping die by means of a series of interconnected cams.

It is a still further object of the invention to provide a convenient and effective arrangement for varying the opening of a gas wiping die by means of a series of interconnected cams or a cam shaft extending more or less parallel to the opening of the die and acting upon a flexible lip of said die.

It is a still further object of the invention to provide an arrangement for varying the opening of a gas wiping die by use of more than one cam shaft.

Further objects and advantages of the invention will become evident from review of the following description and discussion together with the appended drawings.

BRIEF DESCRIPTION OF THE DRAWINGS

FIG. 1 is a transverse cross section through a preferred embodiment of the improved wiping die of the invention.

FIG. 2 is a longitudinal view of the wiping die shown in FIG. 1 viewed in the direction of, or facing the wiping orifice, but with the upper front lip of the die removed.

FIG. 6 is a diagrammatic sketch of a further alternative embodiment showing three cam shafts providing additional flexibility with respect to the cam action.

FIG. 7 is a transverse cross section of an alternative embodiment of the invention in which the cam arrangement directly contacts the flexible lower lip section of the wiping die from outside the plenum chamber of the wiping die.

FIG. 8 is a longitudinal view of the arrangement of FIG. 7 viewed in the direction of the wiping gas orifice with the protective cover normally mounted over the cam arrangement removed.

DESCRIPTION OF THE PREFERRED EMBODIMENTS

Figure 3:
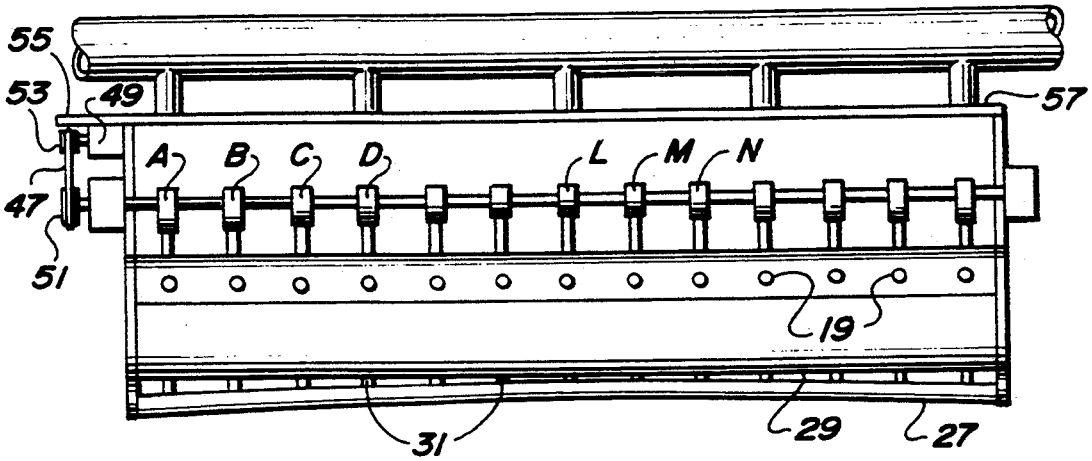
FIG. 3 is a diagrammatic sketch showing the cam arrangement and drive arrangement from the front of the wiping die.

As indicated in the foregoing introductory remarks, the ultimate coating weight on a hot metal coated strip is as a function of a number of factors, including (a) the line speed, (b) the width and surface finish of the strip, (c) strip temperature (d) molten bath temperature, (e) distance of the gas nozzle from the strip, (f) gas flow through the nozzle, and (g) the configuration of the nozzle which determines the configuration of the gas stream, issuing from the gas knife and against the strip. One of the primary factors is the configuration of the gas stream issuing from the gas wiping orifice of the gas wiping die. Furthermore, conditions tend to change as the coating process proceeds. Consequently, it would be desirable to have a universally adjustable gas wiping orifice on a gas wiping die, which orifice could be adjusted not only with respect to the relative opening of said orifice, but also with respect to the contour or relative opening across the lateral extent of the gas orifice. In other words, it may be desirable in some operations, to have the gas wiping orifice relatively wide in the center and narrow toward the two edges so a heavier blast of gas issues from the center of said orifice. On the other hand, it is more frequently desirable to have the ends of the gas orifice relatively wider so that a heavier discharge of gas issues from the ends or extremities of the orifice providing more wiping action upon the edges of the strip where a heavy coating buildup tends to occur due primarily to interference between two oppositely moving gas streams or curtains from the two oppositely directed gas wiping orifices on opposite sides of the strip near the strip edges. This is the so-called edge-wiping or heavy edge phenomenon. If a sheet or strip with a uniformly heavy edge is coiled in the normal manner, the edges of the strip will be progressively turned upwardly as the coil is wound causing an unstable winding condition and in a long section of strip resulting in a coil having a severe camber when uncoiled. Such coils often require a separate flattening operation before being used. In addition, the excess coating on the edges is an economic loss, since, if the specification for the thickness of the coating is attained in the center of the coated strip, the sides of the strip will be too heavily coated with a resulting substantial loss in coating material, the cost of which cannot be recovered due to the fact that the coating weight meets a lesser specification overall.

Various arrangements and mechanisms have been proposed in the past for adjusting the width over all of the coating die orifice or, alternatively, adjusting the shape of the orifice. Such methods may comprise most basically the provision of a series of wiping dies having various configurations of orifice openings. Such arrangements may also comprise separate lip assemblies having differential or adjustable openings between them. A still further alternative which has been used to some extent, but not widely, has been in those arrangements in which the lips of the wiping die may be adjusted either mechanically, usually by rotating a threaded rod of some form to move the lips of the wiping die toward or away from each other, or, in at east one case, thermally, to differentially vary the shape and opening between the lips of the gas wiping die. While these various methods for adjusting the lips of a gas wiping die have had some success, they have, in general, not been satisfactory overall. A major detriment of such prior systems has been the multiple adjustments that must be effected in order to differentially adjust the lips of the coating die. This can require the use of multiple control and motor means. Consequently, there has been a need for a practical, easily operable and easily adjustable means for universally and differentially adjusting the opening between the lips of the wiping die or between various portions of the lips of a wiping die.

The present invention provides the practical arrangement, therefore, for varying the opening between the lips of a wiping die on a predetermined pattern basis as well as for making changes in the gauge of the wiping die in response to changing conditions on a coating line. Such changing conditions may involve changing from one order to a different order frequently requiring the resultant different gauges of metal, different heating conditions or different coating materials. For example, one order may be for one gauge of strip or sheet material and the immediately following order may have a different gauge.

Since metal to be coated seldom, if ever, is entered into a coating pot at the same temperature as the molten metal within the coating pot, any new gauge strip entered into a coating pot will be either extracting heat from the coating pot at a greater or lesser rate or adding heat to the coating pot at a greater or lesser rate than the immediately preceding strip of a preceding order. In many cases, the material being coated will be heated to a higher temperature during pretreatment than the molten coating bath, depending, of course on the composition of the coating bath, and this additional heat is taken advantage of to maintain the temperature of the coating bath. However, a heavier gauge strip or sheet of the same temperature will add more heat to the molten bath displacing, over a period, the temperature of the bath upwardly and resulting in different wiping properties of the molten metal. Since the heated metal strip enters the bath at a very high rate of speed, it may cause relatively significant temperature changes in a very short time. Meanwhile, although adjustments of the heating of the coating pot by its principal heating means may be made to counteract changes in the heating of the strip, such changes can only be made relatively slowly. If relatively quick adjustments of the wiping gas can be made, however, these other changes can be often compensated for.

While the pressure of the gas and thereto, the volume of wiping gas have previously been adjustable relatively quickly, differential adjustment of the wiping gas orifices has not been conveniently attainable on an accelerated basis. The differences which differential heating may make in the relative coating weight across the width of a strip may, by the use of the present invention, be immediately compensated for by changing the relative opening of the slot of the coating die. This is done by adjusting the cam arrangement of the invention to bias one of the lips of the coating die more or less from the opposing lip to open or close that particular portion of the coating die orifice as may be appropriate to maintain uniform conditions of coating of the strip.

The coating characteristics of various coating materials such as, for example, zinc, aluminum and aluminum-zinc combinations are also different and the gauge of the coating across the face of the strip varies particularly dependent upon the weight or density of the coating, since different densities cause more or less of the coating to drain downwardly upon the strip surface back into the molten bath merely through the action of gravitational force. Normally upon the changing of the coating material within the pot, it will be necessary to also change the wiping dies in order to have a wiping die with an orifice contour appropriate to that particular coating material. Obviously, however, changing the coating dies adds an extra cost factor, and even if accomplished during the changing of other elements of the coating bath arrangement, still requires additional personnel, not to say the danger of working above or in the vicinity of a hot metal coating material. By the use of the present invention, however, that is with the use of a cam arrangement for varying the width of the slot orifice in the coating die, rapid changes from one coating material to another may be easily adjusted for merely by providing a cam having sections about its diameter appropriate for several alternative coating materials. This still allows a certain amount of specialized variation on the cam which will enable the process to be adjusted for the particular specialized changes which may be encountered with any particular coating material. Alternatively, a different cam rod with a different cam ratio may be easily substituted for a previous cam rod to alter the available adjustments to the orifice opening available during operation.

The following description in conjunction with the appended drawings is designed to make clear the full advantages as well as the operation of the process of the invention and the construction of the necessary equipment for implementing the process of the invention.

In FIG. 1 there is shown a typical gas wiping coating die 11 comprising a chamber having more or less angular side walls 13 which enclose an open plenum chamber 15. It will be recognized that the plenum chamber 15 extends outwardly and inwardly from the plane of the drawing to form a fairly extensive open space for the receipt of a wiping gas such as air, steam, nitrogen or other suitable gas to be used for providing an elongated gas blast from the orifice of the wiping die to wipe the surface of a metal strip passing the orifice of the wiping die. Such wiping gas may be supplied to the plenum chamber 15 via headers 14 from which a suitable gas is fed via conduits 16 to the plenum chamber 15. The wiping die 11 is provided also with an upper lip 17 secured to the side walls 13 by fastenings 19, usually large industrial or machine screws. Likewise, the lower lip 21 is also secured to the side walls 13 through machine screws 23. It will be understood that the machine screws 19 and 23 extend more or less in a row along the face of the coating die as shown in various of the figures such as, for example, FIGS. 3, 5, 6 and 8 which show the upper lip fastenings 19. The lower end of the upper lip 17 is designated as 25 while the outer end of the lower lip 21 is designated as 27. These ends 25 and 27 are contiguous with each other and define between their surfaces a narrow gas slot 29 through which the gas wiping jet or sheet of gas extends. This slot orifice 29 may have an operating width of perhaps three (3) one hundreds to 4.5 one hundreds inches and is preferably adjustable in accordance with the invention within a range of 0.025 to 0.050 inches. As may be seen from FIG. 2, this adjustment is fairly critical and may be accomplished across the extent of the lip through the action of a continuous series of push or adjustment rods 31 as shown in FIG. 3, only one of which is shown in FIG. 1. Such rods 31 are arranged to press downwardly upon the lower lip 21 to bias it away from the upper lip 17. It will be understood that there are a series of adjustment rods 31 as shown in FIGS. 2 and 3 spaced at intervals along the wiping die in a position to exert downward force against the lower lip at various positions along the length of the wiping die. The lower lip 21 is meanwhile arranged to have a natural resilient action which will tend to bring it back or flex it toward the upper lip 17. In this manner, the resilience of the metal in the lower lip is arranged to tend to close the slot orifice 29 while the adjustment, rods 31 are arranged to resist this closure and maintain the slot orifice sufficiently open for the exit of the amount of wiping gas which it is desired to have pass through that particular portion of the slot.

Figure 11:
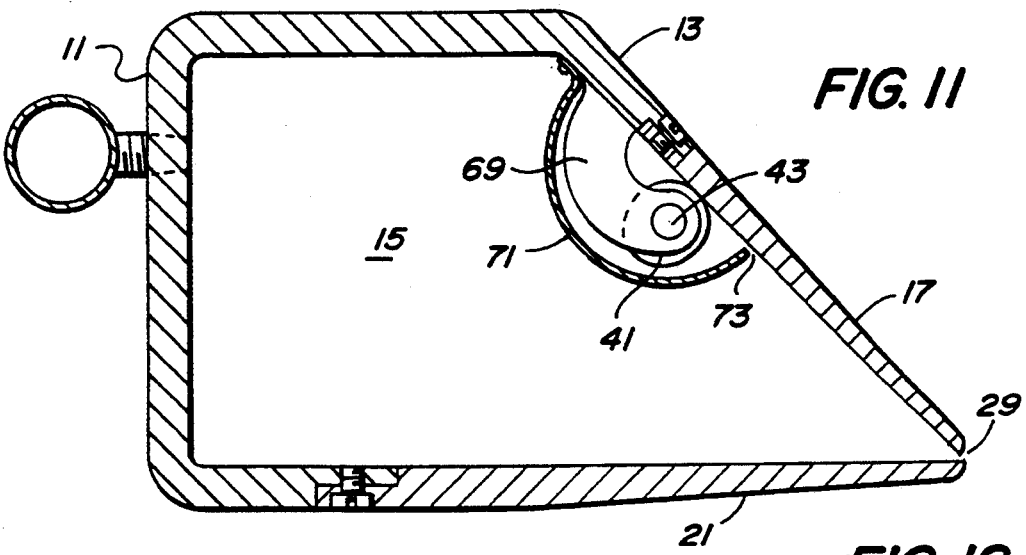
FIG. 11 is a transverse cross section of an alternative embodiment of the invention wherein the cam shaft directly contacts the upper lip of the coating die from inside the plenum chamber.

The upper portions of the adjustment rods 31 pass through a series of bushings 33 in the upper surface of the side walls 13 of the coating die 11. As shown in FIG. 11, the bushings are arranged in a step 35 in the upper portion of the side walls 13 of the coating die 11. However, it will be understood, that the bushings 33 could be positioned in any convenient location within the upper portions of the coating die 11. The upper bearing end 37 of each of the push rods 31 are arranged to contact various cam surfaces 39 of cams 41 spaced at intervals along a cam shaft 43. The cam shaft 43 extends longitudinally along the step 35 of the wiping die and is journaled in conventional fashion in suitable bearings, not shown, at the ends or positioned at strategic intervals along the step 35, or, in other words, along the longitudinal extent of the coating die 11. As shown diagrammatically in FIG. 2, the cam shaft 43 may be turned either by manual adjustment from a suitable crank or other manual means, not shown, for applying torque to the cam shaft 43, or more preferably, by a remote drive means such as an electrical stepping motor or the like controlled from a remote location away from the coating line, or at least away from the immediate vicinity of the hot metal bath. Motor control of the position of the cam shaft may be either controlled by manually operated controls or by computer means as shown, for example, in FIG. 13.

FIG. 3 shows the end of the cam shaft driven by a chain drive 47 from a stepping motor 49 through the action of sprockets 51 and 53 mounted respectively upon the end of the cam shaft and the stepping motor shaft. The stepping motor 49 is in turn shown supported from an overhang on the end of the coating die. Such overhang 55 comprises the end of a structural member or bracket 57 which passes over the top of the coating die 11 and is secured to the upper portion of the side walls 13 of the coating die in any suitable manner. It will be understood that the bracket 57 may be replaced by any other suitable arrangement for supporting the coating die and/or the stepping motor 49.

Figure 4:
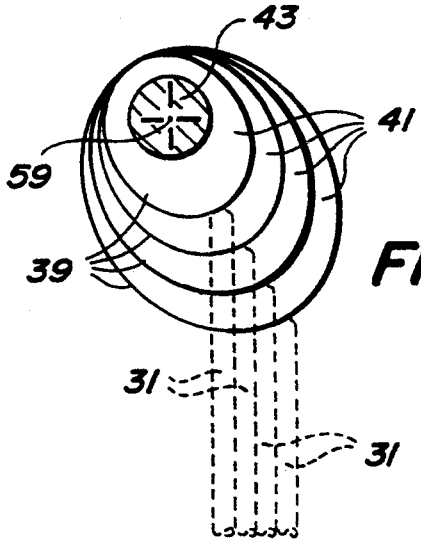
FIG. 4 is an end view of a typical cam shaft of the invention showing various diameters and contours of the cams on such shaft.

FIG. 4 shows an enlarged end view of the cam shaft 43 with the series of separate cams of varying sizes and configurations 41 spaced at various locations along the extent of the cam shaft 43. Normally the cams 41 located at or toward the ends of the cam shaft 43 will be larger in general diameter or "higher" at their largest portion than the cams 41 towards the center of the cam shaft 43. The smaller diameter portion of the cams 41 may be substantially the same height as the surface of the cam shaft 43 or may will be mere extensions of the surface of the cam shaft. Alternatively, they may comprise discrete cam sections on a separate shaft as shown in FIGS. 1 to 3.

As may be seen by reference to FIGS. 1 and 2, when the cam shaft 43 is rotated by the stepping motor 49 shown in FIG. 3, the cams 41 will be rotated into various positions, depending on how much the stepping motor 49 is turned. If the cam shaft 43 is turned from an initial position in which all the cam surfaces are the same elevation or distance from the center 59 of the cam shaft 43, as shown at the upper left in FIG. 4, to a position 180 degrees from the initial position, the cams will be brought into a position in which the distance of the cam surfaces 39 of each cam will be at a maximum distance from the center 59 of the cam shaft 43. This will bias the push rods or adjustment rods 31, as shown in FIGS. 1, 2, 3 and 4, downwardly to a degree dependent upon which diameter of the cam is bearing on its top bearing surface 37. Since the cams 41 designated A, B, C and D in FIG. 3 from the ends of the coating die have the greatest maximum diameters in decreasing order, the push rods 31 at the ends of the die will bias the lower lip 21 of the die downwardly farther at the ends of the coating die than toward the center of the coating die. The minimum biasing is at the center of the coating die where the cam surface 39 of the various cams designated in FIG. 3, for example, as L, M and N, in increasing order from the center cam L, has the minimum diameter or the minimum distance from the center 59 of the cam shaft 43 to the outer cam surface 39.

It will be seen from the above, therefore, that when the cam shaft is in the minimum position, i.e. wherein the cam surface 39 is the minimum distance from the center 59 of the center of the cam shaft 43, the camber of the slot opening 29, or, in other words, the differential between the opening on the ends of the coating die orifice and the opening of the center of the coating die orifice, will be a minimum. In the case where the cam surfaces are all of equal height at this point, the coating die will be arranged with the orifice having the same diameter along the entire extent of the orifice. When such cam shaft, however, is rotated 180 degrees, the distance from the center of the cam shaft 59 and the individual cam surfaces will be maximized and the orifice will be opened a maximum extent in all areas. Since the end cams are normally arranged to have the maximum distance at this point between the center of the cam shaft and the cam surface, the outer portions of the wiping die will be opened up a maximum amount when the cam shaft is at this 180 degrees position. Rotation of the cam shaft an intermediate amount or degree between the minimum and maximum will provide various intermediate openings of the slot of the wiping die. Thus by machining a cam shaft in various configurations and then moving or rotating such cam shaft to a series of predetermined positions to take advantage of these configurations, a regular sequence of adjustments of the die can be made. Such adjustments may be made for various operating conditions. For example, if it is desired to operate the line with a relatively great differential between the opening of the coating die orifice in the center and the opening of the coating die orifice at the sides of the die or the extremities of the die in order to maximize the suppression of edge buildup, the cam may be rotated to the maximum differential position. However, if for some reason coating buildup is significantly less in another operation, the cam may be rotated to a less extreme position.

Alternatively, if the coating conditions tend to change as the operation of the line continues, the stepping motor may be operated progressively to turn or rotate the cam shaft and apply different openings to the coating die orifices to adjust for continuously varying conditions. While for illustration the use of a cam shaft arrangement has been shown in which the contour of the die opening slot is relatively or differentially opened more at the ends of the die as the overall die slot is increased in opening width particularly to compensate for increasing edge buildup, it will be understood that the cam shaft arrangement of the invention can be made with a relative contour which will compensate for various other changes in coating conditions and changes depending upon the operation.

In FIG. 3, the arrangement shown in FIGS. 1 and 2 is shown from the outside of the die facing towards the die orifice. A series of increasing cam diameters across the face of the wiping die from the center may be seen and it will be noted that the opening of the slot orifice 29 at the bottom of the die is greater at the ends. The lower ends of the push rods or adjustment rods 31 may be seen through the slot opening or slot orifice 29 as viewed in FIG. 3. The push rods or adjustment rods 31, although visible in FIG. 3, have a very limited diameter in an actual installation so that they do not seriously interfere with the flow of gas from the slot orifice of the wiping die. In order to minimize any interference with such flow, it is desirable that the adjustment rods 31 be positioned back as far as possible from the opening in the slot orifice as shown in FIG. 1. Other designs may bring the push rods even farther away from the slot opening.

Figure 5:
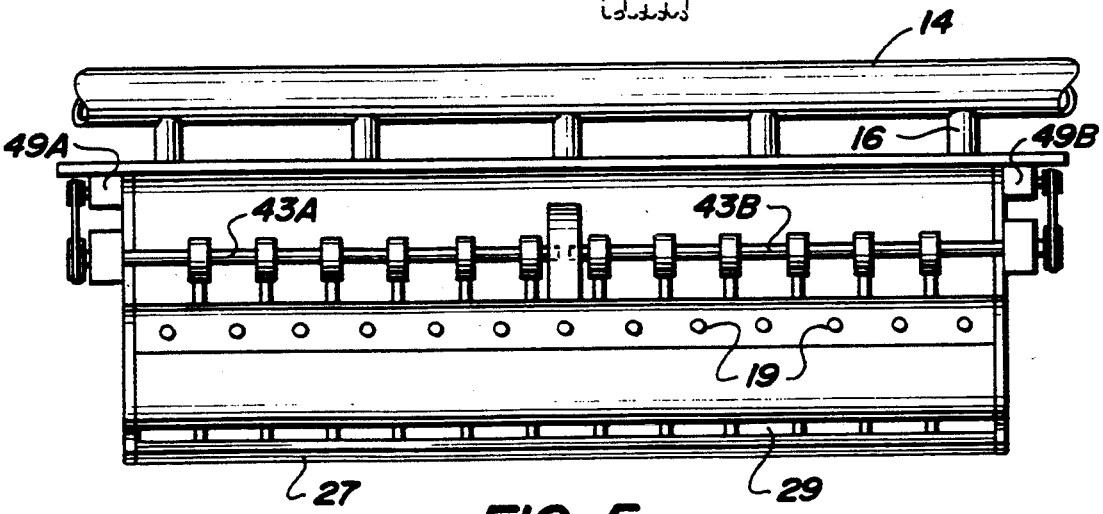
FIG. 5 is a diagrammatic sketch similar to FIG. 3, but of an alternative embodiment of the invention incorporating two cam shafts.

FIG. 5 is similar to FIG. 3, but shows an alternative embodiment of the invention in which there are two separate cam shafts each provided with separate stepping motors **49*a* and 49*b*. It is frequently found that the coating operation has become unequal in that one edge of the coated strip or sheet has a heavier coating than the other edge. In such case, it may be desirable to differentially adjust the coating die openings on opposite edges of the strip. The arrangement shown in FIG. 5 allows such independent adjustment of the die openings adjacent the two edges. In this manner, if there is a heavier edge buildup on one adjacent edge of the strip for one reason or another, the coating die can be opened more adjacent that edge to allow more for adjustment of the coating on that side by applying a heavier or more vigorous blast of coating wiping gas on that side. It will be understood that in the apparatus of FIG. 5, a series of cams on each cam shaft will have different maximum diameters, usually based largely upon having a lesser/maximum on that portion of the cam which is to be used in the center of the die and a greater/maximum diameter on that portion of the cam shaft which is to be mounted near the edges of the coating die. Rather than having a generally curved configuration, therefore, which will provide first a maximum opening, decreasing to a minimum opening near the center of the die and then back to a maximum opening near the other end of the die, each individual cam shaft will have merely a series of diameters which will provide a minimum opening of the die orifices at one end of the cam shaft and a maximum opening at the other end when the cam shaft is turned to its maximum differential extent. As indicated above, this particular sequence is merely illustrative of a frequently used contour for the die opening and various changeable contours can be provided for. As in the arrangement shown in FIGS. 1, 2, 3 and 4, the cam shafts in FIG. 5 may be adjusted either manually by crank means or preferably by stepping motors as shown. Where an automatic control system is used to control the operation of the stepping motors, it will obviously be necessary to incorporate a somewhat more sophisticated control means for maintaining the relative rotation of the cam shafts at a desired proportion. When there are two contiguous cam shafts, it will usually be found desirable to have the minimum height of the cams uniform completely around the two closest adjacent cams so that when these two ends are placed next to each other, the adjustment of the adjacent portions of the lips of the die will be the same regardless of what relative position the adjustment of the two cam shafts take. For convenience in illustration, the camber of the slot opening 29 is shown in FIG. 5** uniform across its width.

FIG. 6 shows a still further alternative arrangement of the invention which provides not just two (2) separate cam shafts, but three (3) separate cam shafts, 43*a*, 43*b* and 43*c*, each operated by a separate stepping motor 49*a*, 49*b* and 49*c*. As will be understood, this arrangement provides certain advantages of flexibility of the coating line, but also has increased complexity and may be worthwhile only in certain specific lines where complete flexibility is particularly important. The cams and slot opening are again for convenience shown uniform and, in fact, the variations in an actual installation may be so small as to be scarcely detectable with the naked eye.

While the arrangement shown in FIGS. 1, 2, 3 and 4 and their variations shown in FIGS. 5 and 6 are very effective and easily implemented, the adjustment rods extending through the plenum chamber of the coating die do introduce a minimum of turbulence and possible variations in the gas wiping jet issuing from the slot in the gas wiping die.

FIG. 7 shows an alternative arrangement for a wiping die in which the cam shaft 43 and cams 41 are journaled in bearings, not shown, on structural brackets 63 attached to or constituting extensions of the side wails 13 of the coating die. See, for example, FIG. 8. The cam shaft and structural brackets 63 are mounted below the wiping die in a position such that the cam surfaces bear against the underside of the lower lip 21 of the wiping die. The stiff structural brackets 63 hold the cam surfaces 39 tightly against the bottom portion of the flexible lower lip 21 of the wiping die so that as the relative elevation of the cam surfaces changes with respect to each other as the cam shaft rotates, the flexible lip may be pressed more or less inwardly to partially close the gap of the slot orifice 29. In the embodiment shown in FIG. 7, it will be understood that the flexible lower lip 21 is arranged to have its normal flexing in an outward direction so that such flexing will be opposed by the surfaces 39 of the cams 41. The upper lip 17 is arranged essentially in the same position as in the other die shown in the FIGS. 1 to 4. It is preferable to have a cover 65 mounted over the cam shaft 43 and cams 41 to prevent them from being splashed by hot metal from the molten coating bath located under the wiping dies. Obviously, if molten metal splashed upon the cam surfaces, it would change, at least temporarily, the critical machining of such surfaces and interfere with accurate operation and biasing of the lower lip 21 of the wiping die 11.

FIG. 8 is a longitudinal view of the wiping die shown in FIG. 7 viewed in the direction of the orifice slot 29 and showing the cam shaft 43 and the various cams 41 arranged under the main structure of the wiping die. In FIG. 8, the cover 65 for the cam shaft arrangement has been removed in order to better show the cam arrangement. It will be noted that, since the cam shaft is positioned beneath the lower lip, there is absolutely no impediment within the plenum chamber 15 which might interfere with even egress of the wiping gas originally derived from the manifolds 14 from plenum chamber 15 through the slot orifice 29. The arrangement of a stepping motor 49 at the end of the wiping die is shown in FIG. 8 in a position to operate the cam shaft 43. An outwardly increasing camber of the die opening 29 is shown in FIG. 8.

Figure 9:
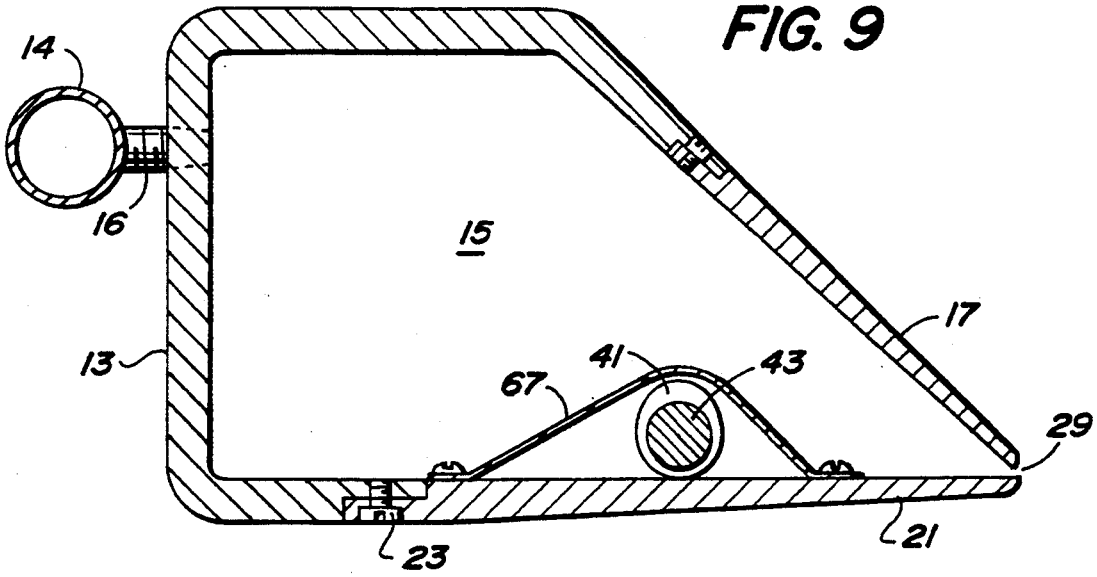
FIG. 9 is a transverse cross section of an alternative embodiment of the invention wherein the cam shaft directly contacts the flexible lower lips from inside the wiping die plenum chamber.

FIG. 9 shows a still further embodiment of the invention in which thee cam shaft 43 and cams 41 are positioned directly against the flexible lower lip in a somewhat similar manner to that shown in FIG. 7 except that the position of the cams is above the lip 21 rather than below the lip 21. It will be understood that the permanent biasing of the lip 21 will, in the case of FIG. 9, be toward the upper lip 17 rather than away from it as in FIG. 7. Preferably, a smoothly contoured cover 67 is provided within the interior of the plenum chamber 15 of the wiping die shown in FIG. 9. Such smoothly contoured cover prevents the inevitable hump occasioned by the presence of the fairly sturdy and substantial cam shaft 43 and cams 41 mounted thereupon from interfering with smooth flow of gas from the plenum chamber 15 through the slot orifice 29. Since the cam shaft 43 and cams 41 are maintained completely within the interior of the wiping die structure, they are in a fairly clean, non-contaminated atmosphere and it is, therefore, not necessary that a tight fit be maintained between the cover and the flexible lower lip 21. This allows the lip 21 to be easily flexed without interference from the cover. Such cover 67 is, as indicated above, present not so, much as a protective cover to shield the cams 41 and cam shaft 43, but to attain a smooth flow of gas across the cover which gas might otherwise be forced into turbulence by passage past the uneven surfaces of the cams. It will be understood that both the size of the cam shaft shift and the height of the cover 67 has been exagerated in FIG. 9.

Figure 10:
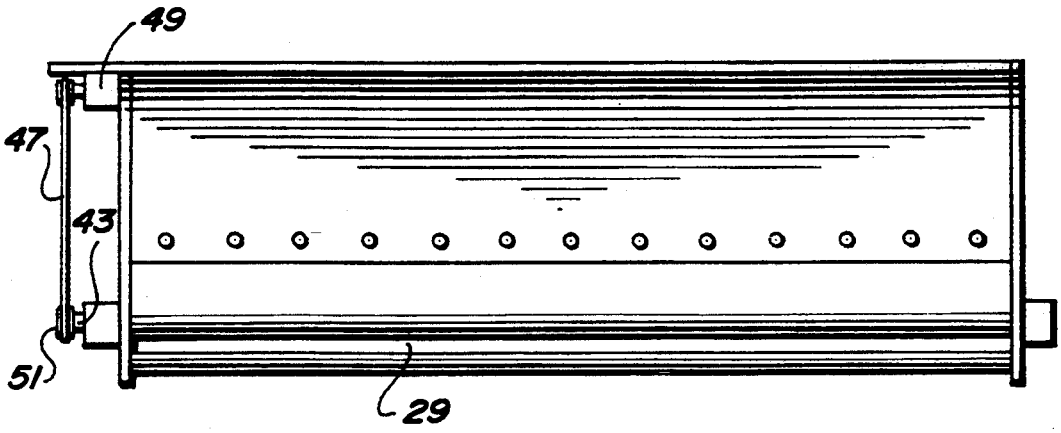
FIG. 10 is a front view of the embodiment shown in FIG. 9.

FIG. 10 shows a longitudinal outside view of the wiping die shown in FIG. 9. It will be noted in FIG. 10 that the slot orifice does not appear constricted by the presence of adjustment rods or other extraneous mechanical devices which might interfere with the smooth flow of wiping gas from the orifice.

Figure 12:
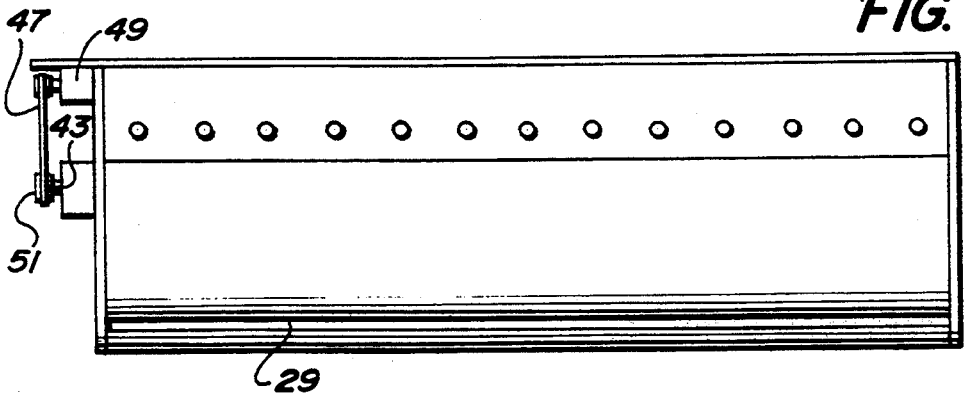
FIG. 12 is a front view of the embodiment shown in FIG. 11.

FIG. 11 shows a still further alternative embodiment of the invention in which the flexible lip is the upper lip 17, and such lip is biased from the inside by means of a rotatable cam arrangement. As in FIGS. 7 and 9, the cam shaft 43 and cams 41 supported upon such shaft are supported in turn upon a structural bracket 69 which is attached securely to the end of the upper side wall 13. In FIG. 11, the flexible lip 17 will be permanently biased inwardly toward the plenum chamber and the cams 41 will serve to press such lip 17 outwardly away from the plenum chamber and also away from the slot orifice 29 so that said slot orifice is maintained open to allow wiping gas to pass therethrough in a thin sheet which serves to wipe the surface of the strip or sheet passing up from a coating bath past the end of the wiping die 11. Both the structural bracket. 69 and the cam shaft 43, as well as the cams 41 attached thereto, are preferably protected by cover 71 which, as seen in FIG. 11, is securely attached to the inside of the sidewall 13 of the coating die and extends downwardly over the cam assembly to generally protect the cam assembly from the contents of the plenum chamber 15. A space or clearance 73 is provided, however, between the end of the cover 71 and the inside surface of the flexible upper lip 17 to allow clearance for movement of the flexible lip 17. As in the previous embodiments, flexible lip 17 is biased so that it normally flexes itself in a direction opposite to the direction in which it is forced outwardly by the cam surfaces. While some of the wiping gas will get into the cam chamber behind the cover 71, no harm will be done since the gas, even in the case of steam, is clean and unpolluted. As in the previous embodiments in FIGS. 7 and 9, it will be seen in FIG. 11 that the cam arrangement is substantially out of line with the slot orifice so that neither the cams nor the cover over the cams interferes in any way with the gas exiting from the slot orifice 29. FIG. 12 is a front view of the coating die of FIG. 11 showing the unobstructed die orifice 29 and clean appearance similar to FIG. 10.

It will be understood in FIGS. 7, 9 and 11 that while the cam means are shown in the form of a single cam, usually rotated by a stepping motor mounted at one end of the die, that double or multiple cams can be used such as shown in FIGS. 5 and 6.

Figure 13:
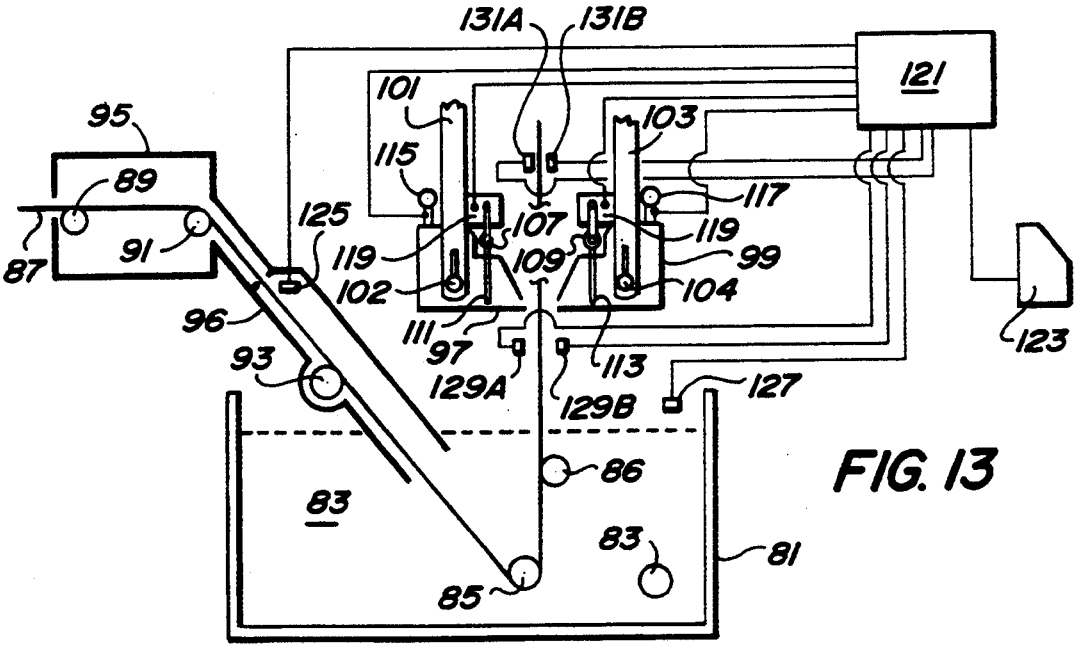
FIG. 13 is a diagrammatic sketch of a control system associated with a pair of wiping dies similar to those shown in FIGS. 1 and 2 mounted on a hot dip coating line.

FIG. 13 shows a diagrammatic sketch of a coating apparatus making use of the preferred wiping dies of the invention as shown in FIGS. 1 through 4. In FIG. 13, a coating pot 81 for a hot-dip-coating-type metal such as aluminum, zinc or aluminum-zinc, shown as a pool of molten coating metal 83 in the pot 81, is arranged with a sinker roll 85 held at a predetermined depth within the molten metal 83 and a stabilizer roll 86 just below the surface of the molten metal. A metal strip such as a steel strip 87 passes into the hot metal through the surface after having passed over guide rolls 89, 91 and 93. The guide rolls 89 and 91 are contained within a muffle furnace 95 where the strip is heated, usually in a reducing atmosphere, prior to passing into the molten metal 83. A pair of gas wiping dies 97 and 99, which as indicated above, are substantially identical to those shown diagrammatically in FIGS. 1 through 4 are supported upon structural support members 101 and 103 upon which they are pivoted at 102 and 104 at a predetermined height above the not metal bath. The steel strip 87 passes upwardly from the sinker roll 85 past the stabilizer roll 86 and between the gas wiping dies 97 and 99 in a position such that each side of the strip will be wiped by a preheated pressurized gas curtain issuing from the slot orifice of each wiping die. The wiping dies 97 and 99 are both provided with cam means 107 and 109 acting through push rod means 111 and 113 to bias the lower lips of the wiping dies 97 and 99 to provide a differential thickness curtain of gas to wipe the surface of the strip 87 in order to establish a desired thickness of coating upon such surface. The wiping dies 97 and 99 are shown partially broken away to reveal the push rod means 111 and 113 extending vertically inside.

The gas curtain issuing from the slot orifices of the gas wiping dies serves to wipe back excess coating into the coating bath 83. The gas for the wiping dies 97 and 99 is provided through headers 115 and 117 which are supplied with the gas through any suitable source. An electrical stepping motor is provided in conjunction with each coating die 97 and 99 to control the rotation of the cam means 107 and 109. Meanwhile, a main computer control means 121 is supplied to control the wiping of the strip or sheet automatically. The computer control means 121 is, in itself, controlled from a console 123 which may provide, through manual manipulation, input data indicating what thickness of coating is to be applied to the surface of the strip or sheet. The main computer control is provided with a number of sensors 125, 127 and 129 to detect respectively, the temperature of the strip issuing from the muffle furnace 95 and passing through the snout or hood 96, the temperature of the hot metal bath 83, the thickness of coating on the strip issuing from the bath on both sides of the strip, the temperature detector on the one side of the strip being denoted as detector 129A and the detector on the other side of the strip being denoted as detector 129B. A further detector, again with one detector on each side of the strip, is a coating thickness detector pair 131A and 131B provided above the wiping dies, The two detectors 131A and 131B detect the final coating thickness after the strip has passed through the coating detectors and preferably after the coating has solidified upon the surface of the strip, although this is not strictly necessary. Each one of these detectors is connected to the main computer control by a suitable signal line.

A control line passes also from the computer control 121, to each of the headers 115 and 117 feeding gas to the coating dies as well as to the stepping motors 119 which control each of the cam means. These control lines serve to automatically position the cam means to open or close the slot orifice or wiping orifices of each wiping die to the best differential opening across the face of the die for the particular coating conditions. They also control the amount of gas passing to the coating dies through the headers by means usually of a butterfly valve in the headers. These additional control features are not shown, as they are conventional in the art.

Figure 14:
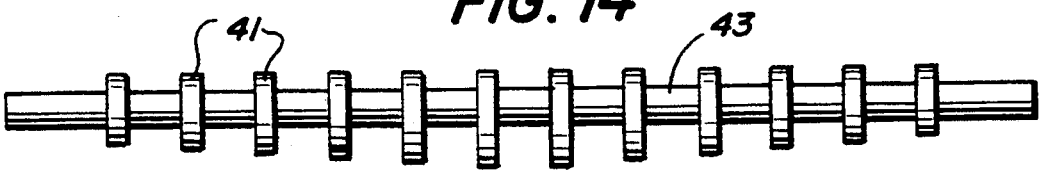
FIG. 14 is a view along the side in a longitudinal direction of a cam shaft made in accordance with one frequent arrangement or embodiment of the invention.
Figure 15:
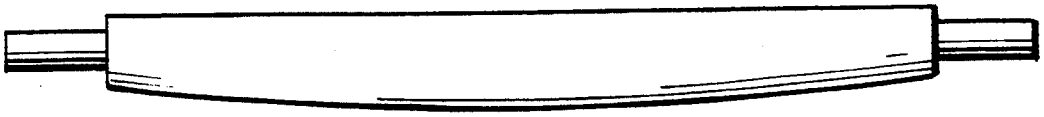
FIG. 15 is a view along the side in a longitudinal direction of an integral cam shaft and cam arrangement in accordance with another embodiment of the invention.
Figure 16:
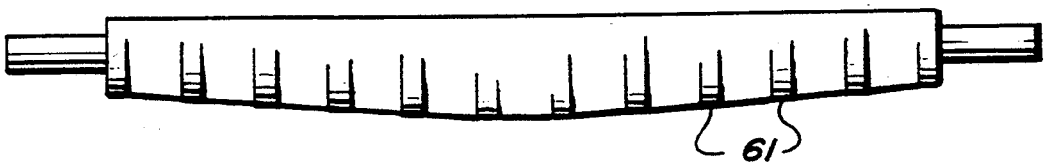
FIG. 16 is a view along the side in a longitudinal direction of a further embodiment of the present invention.

FIGS. 14, 15 and 16 show for comparison longitudinal views of forms of cam shafts 43 having either integral cams or separate cams 41 rigidly secured to its surface similar to those shown in the previous views. In FIG. 14 the cam shaft is shown by itself with a series of differentially proportioned cams equally spaced along the shaft. The overall camber is shown generally convex rather than concave as shown in the other illustrations to illustrate that various contours of the cam shaft may be used for various control functions. It can be seen in FIG. 14 that the top of the cams upon the cam shaft has a substantially parallel series of cam surfaces whereas the bottom of the cam shaft, i.e. 180° from the parallel series of cam surfaces, has a generally convex arrangement of cooperating cam surfaces which define, as shown, a convex shape, which, it will be understood, could also be concave and might more usually be concave in outline. The cam arrangement shown in FIG. 14 is designed especially for use with the dies shown in the previous figures where only either a push or adjustment rod bears directly upon the flexible lip which is ultimately moved by the cams or, alternatively, the cam surfaces bear directly upon the surface of the flexible lip of the coating die. It will be understood that various configurations and combinations of cams may be used together to obtain various arrangements of the cam surfaces and contours of the ultimate flexible die surfaces.

FIG. 15 shows a modified type of cam in which the cam shaft itself provides essentially the surface of the various cams of the various sections. This is a substantially solid cam arrangement which, it will be noticed, has essentially the same overall outline of cam surfaces as in FIG. 14.

One disadvantage of the arrangement shown in FIG. 15 is that surfaces of the cams are inclined at the same angle as the overall change between the cam positions. This is a disadvantage because of the inclined point of contact with other mechanical means which may tend to be detrimentally displaced to the side, particularly in the operation of adjustment rods such as shown in FIGS. 1 through 4. However, this disadvantage can be obviated by providing a cam shaft such as shown in FIG. 16. In the cam shaft shown in FIG. 16, each of the cam locations for operation of a push rod is provided with a uniform surface parallel to the central axis of the cam shaft so that there are, in fact, "flat," although upwardly curved, cam surfaces 61 for the push rods to bear against. It will be seen that FIGS. 14 and 16 are substantially equivalent to each other with the exception that the excess metal between the cam sections has been removed in FIG. 14 to make a lighter, but not necessarily stronger or cheaper structure.

Figure 17:
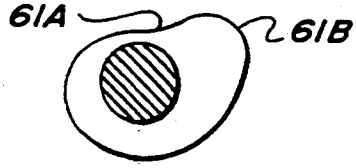
FIG. 17 is an end view of one contour of cam arrangement on a cam shaft in accordance with the present invention.

Various cam outlines may also be used. For example, a normal cam outline having a progressively increasing distance between the center of the cam shaft and the edge of the cam surface from one port,ion to another is shown in FIG. 4. Another possible arrangement is shown in FIG. 17 in which instead of the maximum distance between the center of the cam shaft and the surface of the cam, i.e. the highest uniform section, being located at 180° from the portion having the lowest uniform section, the distance of the cam surface from the center of the cam shaft instead increases from the minimum distance steadily as the cam turns until the maximum distance between the two points is found at a location of about 300 or more degrees about the cam shaft progressing in one direction. The distance of the cam surface from the center of the cam shaft then decreases precipitiously to bring it back to the minimum or lowest uniform section. The arrangement shown in FIG. 17 provides a wider range of attainable adjustments over a cam shaft having the same diameter as the cam shaft arrangement shown in FIG. 4. In other words, in FIG. 4, the increase in size of the cam shaft occurs over one-half of the distance about the cam shaft, while in FIG. 17 the same increase in distance occurs over more than three-quarters of the circumference of the cam or cam shaft allowing basically a more gradual increase which will give finer control with a less precise movement of the cam shaft. The lowest cam portion in FIG. 17 is at 61A while the maximum cam diameter is at 61B fairly close by.

Figure 18:
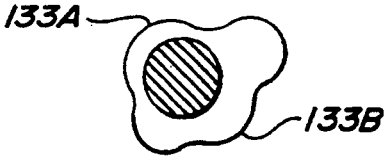
FIG. 18 is an end view of an alternative cam contour on the cam shaft of an alternative embodiment of the present invention.

Other arrangements are also possible such as, for example, that shown in FIG. 18 where the cam surface progresses in a series of steps from lesser to greater distances between the center of the cam shaft and the surface of the cams. As seen in FIG. 18, the series of steps 133 provide longer areas, for example 133A and 133B, of more or less uniform cam action elevation and push rod action. This arrangement also has advantages in obtaining increased preciseness of movement with a less precise prime mover. In other words, a stepping motor or other movement providing means does not have to be as precise in operation to arrive at a given elevation on the cam surface. Instead, certain predetermined, desirable surface elevations are provided already machined on the surface, which the stepping motor or other motive unit need merely reach fairly imprecisely and which will then be held for a significant distance on the cam as the cam shaft turns so that there is less danger that an imprecise opening of the die lips may be attained by an anomaly in the operation of the motive means. Other possible variations of the cam surfaces to operate the cam of the invention will occur to those skilled in the art.

Figure 19:
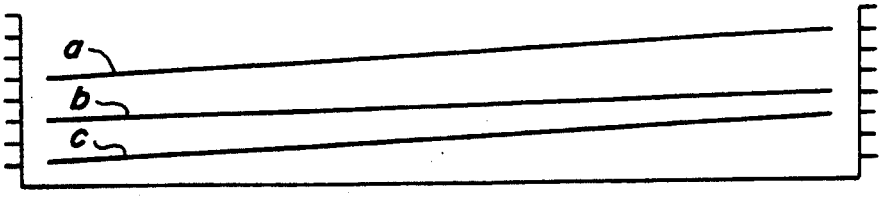
FIG. 19 is a graphical presentation of the contour of the coating of a coated strip exhibiting a differential contour from end to end, said strip having been coated without using the present invention.

FIG. 19 is a plot showing schematically the coating gauge or thickness of a lengthy strip or sheet passing through a coating bath where the strip or sheet is cooler than the bath temperature. Plot A is for thickness of the coating on one edge of the sheet and plot C is for the thickness of the coating on the other edge of the sheet, while plot B is the thickness of the coating in the center of the sheet. The gauge of the coating thickness are plotted on the abscissa of the graph in relative terms, i.e. an increase in coating thickness is shown by increase in the position of the graph for each coating, such positions being plotable according to the index marks on the abscissa at the left and the right of the graph. The index marks, however, do not have any absolute values other than that the marks are 1000th of an inch apart. Consequently, if the strip coating increases by 1000th of an inch, or one mil, the elevation of the plot will rise from one index mark to the next. The three plots, A, B and C, for different portions of the strip, consequently do not indicate that the coating is thicker on A than on C, but only show the relative increase in the coating from one end of the strip at the left of the plot to the other end of the strip at the right of the plot.

It may be seen in FIG. 19 that the center of the strip tended to become more thickly coated, but only to a relatively minor extent, while the edges of the strip A and C were more subject to an increase in coating thickness due to heavy edge coating effect which became relatively more pronounced as the temperature of the bath decreased due to the cooling of the strip entering into the bath causing more material to adhere to the strip surface, basically because the molten coating material becomes slightly more viscous with decreasing temperature.

Figure 20:
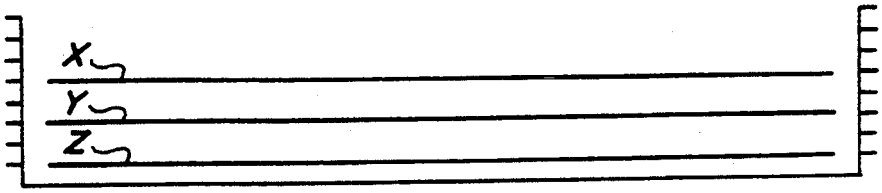
FIG. 20 is a graphical presentation of the contour of the coating from one end to the other of a coated strip made using the present invention.

FIG. 20 shows the same type of plot as in FIG. 19. In the case of FIG. 20, plots X and Z plot the relative thickness of coating on the edges of a strip or on the surface of the strip near the edges, while the plot X indicates the thickness of the coating in the center of the strip. The coating line in operation, plotted in FIG. 20, is an illustration of typical results to be expected from a line such as shown in FIG. 13 when equipped with a means such as the cam arrangement shown in the drawings to gradually increase the opening of the gas orifice and the gas wiping dies, particularly near the edges of the dies as the coating process proceeds from one end to the other strip being coated. It will be seen that the predetermined camber of the cam surfaces has effectively counteracted the progressively increasing viscosity of the coating by opening the gas wiping die's orifices sufficiently to counteract such increasing viscosity by wiping additional coating from the surface of the strip. The control system 121, shown in FIG. 13, through detection of the temperature of the strip and of the bath material operates the stepping motors which turn the cam surfaces at a rate which will maintain both the temperature of the bath material more constant and at the same time, compensates for the increasing viscosity of the molten bath material by increasing the gas blast issuing from the slot orifices of the wiping dies. Since essentially the same series of increases tend to occur in each coating bath subjected to this phenomenon, a cam which will correct for this type of changes can be fairly easily designed.

As will be recognized, if the relative increase in the cam surfaces of the cam rod shown in either FIGS. 14, 15 or 16, are carefully calculated beforehand, and the rapidity of change of the stepping motor is also carefully orchestrated by a computer means or even, alternatively, by manual means, the continuous compensation demonstrated by FIG. 20 for a slow and undesirable increase in the amount of coating on a strip can be easily compensated for. It will be recognized that if manual turning of the cams are provided, that the compensation will be somewhat stepwise, since very fine adjustments will not be practical. However, three to four adjustments of the cam rotation during the run through of a strip will successfully even out the coating to a considerable extent. Naturally, however, it is very desirable to have a computer run the stepping motors. Alternatively, the motors can be run manually, again, however, with the somewhat stepwise adjustment which this provides. A more uniformly coated strip on the average, however, will still result.

It will also be recognized, that a coating line making use of the cam rod adjustments of the present invention will normally have available a series of cam rods which may be easily substituted for each other, depending upon the operation of the line. For example, a given line may well have a master cam rod which will take care of most changes on a line and allow the line operators to compensate particularly over a period for heavy edge buildup and the like. However, at the same time, other specialized cam rods may be produced and kept available at the site to compensate for specialized conditions or to provide specialized adjustment for the openings in the coating knives.

While the present invention has been described at some length and with some particularlity with regard to several embodiments, it is not intended that the invention be limited to any such particulars or embodiments, but it is to be construed broadly with reference to the appended claims so as to provide the broadest possible interpretation of such claims in view of the prior art and thereby to effectively encompass the intended scope of the invention.

I claim:

1. An adjustable die for smoothing and wiping liquid coating material on flat elongated material moving past said die using a fluid wiping medium issuing from said die comprising:

(a) a die body encompassing a plenum chamber and an elongated orifice along one side for egress of said fluid wiping medium, (b) means for supplying pressurized fluid wiping medium to said plenum chamber, (c) a pair of fluid confining members on each side of the elongated orifice for defining the opening between said fluid confining members and therefore the conformation and/or dimensions of any stream of fluid wiping medium passing through the orifice, (d) at least one of said fluid confining members being resiliently biasable toward or away from the other of said pair of fluid confining members, (e) said resiliently biasable confining member being in at least indirect physical contact with at least two different contour variable position cam surfaces arranged and constructed to bias the resilient fluid confining member at two different points in line with the elongated orifice in directions which will redefine the conformation and dimensions of the elongated orifice and therefore the stream of any fluid wiping medium passing through the orifice, and (f) said variable position cam surface being adjustable with respect to its position by means of a movement engendering means.

2. An adjustable wiping die in accordance with claim 1 wherein the pair of fluid confining members comprise integrally resilient lip means on the wiping die.

3. An adjustable wiping die in accordance with claim 2 wherein there are a plurality of differentially contoured variable position cam surfaces in at least indirect contact with the resilient biasable lip means.

4. An apparatus for smoothing and wiping liquid material on a strip by gas wiping comprising:

(a) an elongated plenum chamber connected to manifold means for supplying a wiping gas to said plenum chamber, (b) a pair of oppositely disposed lips associated with said plenum chamber and defining an elongated gas ejection and wiping orifice on said plenum chamber, (c) at least one of said oppositely disposed lips having a resilient construction enabling the outer end of said lip to be adjustably positioned with respect to the other lip to thereby vary the orifice width between the lips, (d) a plurality of differential cam surfaces provided about a transverse shaft mounted substantially parallel to the orifice between the lips such that the cam surfaces are in at least in direct contact with a surface of said lip having a resilient construction such that rotation of said shaft will differentially alter the contour of said lip and the elongated gas ejection and wiping orifice in a predetermined ratio.

5. An apparatus in accordance with claim 4 wherein natural flexure of the lip is toward the opposite lip and the shaft and the associated cam surfaces are journaled within the plenum chamber adjacent and in effective contact with one side of the flexible lip.

6. An apparatus in accordance with claim 4 wherein natural flexure of the lip is away from the opposite lip and the shaft and associated cam surfaces are located outside of the plenum chamber in at least indirect contact with said lip.

7. An adjustable die for smoothing and wiping liquid coating material on flat elongated material moving past said die using a fluid wiping medium issuing from said die comprising:

(a) a die body encompassing a plenum chamber and an elongated orifice along one side for egress of said fluid wiping medium, (b) means for supplying pressurized fluid wiping medium to said plenum chamber, (c) a pair of fluid confining members on each side of the elongated orifice for defining the opening between said fluid confining members and therefore the conformation and/or dimensions of any stream of fluid wiping medium passing through the orifice, (d) at least one of said fluid confining members being resiliently biasable toward or away from the other of said pair of fluid confining members, and comprising a resilient lip means, (e) said resiliently biasable confining member being in at least indirect physical contact with a plurality of variable position cam surfaces arranged and constructed to bias the resilient fluid confining member in a direction which will redefine the conformation and/or dimensions of the elongated orifice and therefore the stream of any fluid wiping medium passing through the orifice, and (f) said variable position cam surface being adjustable with respect to its position by means of a movement engendering means.

8. An adjustable wiping die in accordance with claim 7 wherein the plurality of variable position cam surfaces are provided upon a rotatable cam shaft rotatable by the movement engendering means.

9. An adjustable wiping die in accordance with claim 7 wherein the variable position cam surfaces are defined by a variable conformation cam surface positioned along a rotatable cam member which is rotatable by a stepping motor.

10. An adjustable wiping die in accordance with claim 7 wherein the resilient lip means is permanently biased in a direction opposite to which the variable position cam surface will physically urge the lip means.

11. An adjustable wiping die in accordance with claim 8 wherein the variable position cam surfaces are in indirect contact with said resilient lip means through a plurality of independent intermediate biasing members.

12. An adjustable wiping die in accordance with claim 1 wherein the variable position cam surfaces are in direct contact with the resilient lip means to bias said lip means.

13. An adjustable wiping die in accordance with claim 11 wherein the plurality of independent intermediate biasing members comprise independently movable push rod means extending between the variable position cam surfaces and the resilient lip means.

14. An adjustable wiping die in accordance with claim 12 wherein the variable position cam surfaces are defined by substantially adjacent cams mounted on a cam shaft.

15. An adjustable wiping die in accordance with claim 12 wherein the variable position cam surfaces are defined by a substantially continuous variable conformation cam surface on a rotatable cam member.

16. An adjustable wiping die in accordance with claim 9 wherein operation of the stepping motor to rotate the rotatable cam member is controlled by a control system means in a predetermined sequence.

17. An adjustable wiping die in accordance with claim 9 wherein operation of the stepping motor to rotate the rotatable cam member is controlled by a control system in accordance with a predetermined pattern based upon coating operation data provided to the control system.

18. An adjustable wiping die in accordance with any one of claims 14, 15 and 9 wherein there are at least two separate cam shafts for adjusting separate sections of the resilient lip means.

19. An apparatus for smoothing and wiping liquid material on a strip by gas wiping comprising:

(a) an elongated plenum chamber connected to manifold means for supplying a wiping gas to said plenum chamber, (b) a pair of oppositely disposed lips associated with said plenum chamber and defining an elongated gas ejection and wiping orifice on said plenum chamber, (c) at least one of said oppositely disposed lips having a resilient construction enabling the outer end of said lip to be adjustably positioned with respect to the other lip to thereby vary the orifice width between the lips, (d) a plurality of differential cam surfaces provided about a transverse shaft mounted substantially parallel to the orifice between the lips such that the cam surfaces are in effective contact with a surface of said resilient construction lip so that rotation of said shaft will differentially alter the contour of said flexible lip and the adjacent gas wiping orifice in a predetermined ratio, and (e) wherein the natural flexure of the flexible lip is toward the opposite lip and the shaft and the associated cam surfaces are journaled within the plenum chamber adjacent and in effective contact with one side of the flexible lip.

20. An apparatus in accordance with claim 19 additionally incorporating a shield means separating the cam means in contact with said lip from the main portion of the plenum chamber,

21. An apparatus in accordance with claim 19 wherein the plurality of differential cam surfaces are in indirect contact with the flexible lip through a plurality of independent intermediate biasing members.

22. An apparatus in accordance with any one of claims 6, 19, 21 wherein the transverse shaft is rotatable by a stepping motor.

23. An apparatus in accordance with claim 22 wherein there are at least two separate shafts with associated cam surfaces in contact with different lateral portions of said lip.

* * * * *